US005147061A

United States Patent [19]

Karpisek

[11] Patent Number: 5,147,061

[45] Date of Patent: Sep. 15, 1992

[54] CONTAINER DISCHARGE SIDE DOOR

[76] Inventor: Ladislav S. Karpisek, 86 Woodfield Boulevarde, Caringbah, New South Wales 2229, Australia

[21] Appl. No.: 730,852

[22] PCT Filed: Nov. 19, 1990

[86] PCT No.: PCT/AU90/00557

§ 371 Date: Jul. 22, 1991

§ 102(e) Date: Jul. 22, 1991

[87] PCT Pub. No.: WO91/08149

PCT Pub. Date: Jun. 13, 1991

[30] Foreign Application Priority Data

Nov. 29, 1989 [AU] Australia ..... PJ7611

[51] Int. Cl.[5] ..... B65D 88/00

[52] U.S. Cl. ..... 220/334; 220/1.5; 220/403

[58] Field of Search ..... 220/1.5, 254, 315, 324, 220/334, 402, 403

[56] References Cited

U.S. PATENT DOCUMENTS

| | | | |
|---|---|---|---|
| 1,227,354 | 5/1917 | Wolterstorff | 220/254 |
| 1,949,508 | 3/1934 | Woodall | 220/334 X |
| 2,089,251 | 8/1937 | DeFrees | 220/334 X |
| 2,318,151 | 5/1943 | Gary | 220/324 |
| 4,793,519 | 12/1988 | Voorhies, Jr. | 220/403 X |
| 5,050,765 | 9/1991 | Roser et al. | 220/403 X |

*Primary Examiner*—Steven M. Pollard
*Attorney, Agent, or Firm*—Edwin D. Schindler

[57] ABSTRACT

A container discharge side (7) comprising a frame (11, 12, 13, 14, 15) with a two-part covering comprised of an upper covering sheet (17) fixed to the frame and an openable lower covering sheet (27) with hinge means (29, 31, 32) connecting the lower covering sheet (27) to the frame so the lower covering sheet (27) is outwardly downwardly movable in an opening mode between the frame uprights (12, 13), an upwardly outwardly opening gate (G) is connected by hinges (25) to the frame, releasable locking means (26) maintain the gate (G) closed in overlying relationship with the lower covering sheet (27) when it is closed and forms a substantially coplanar extension of said upper covering sheet (17).

9 Claims, 4 Drawing Sheets

CONTAINER DISCHARGE SIDE DOOR

Figure 1:
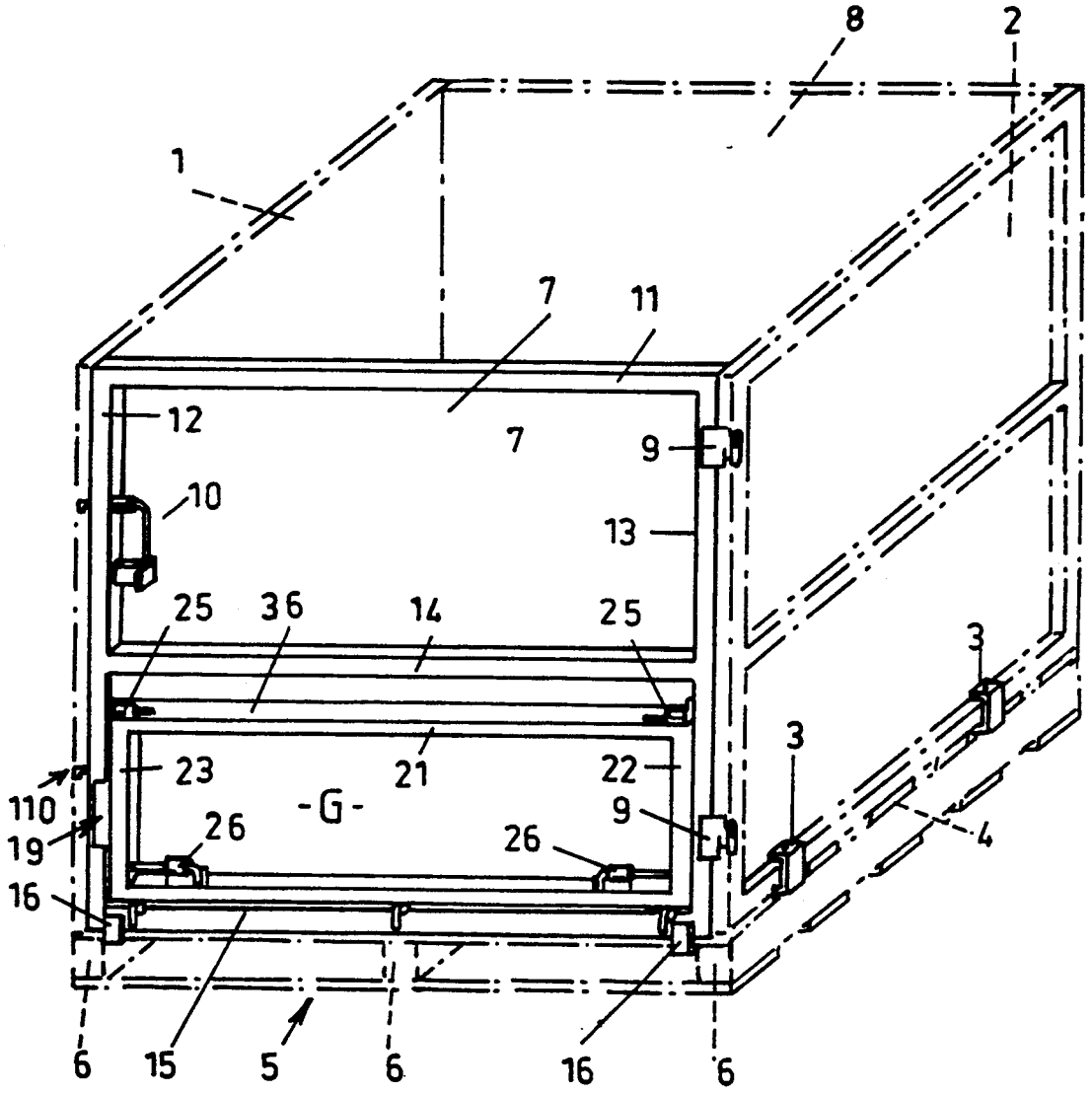

This invention relates to gravity discharge containers of the type used to transport flowable non-liquid materials, such as pelletised plastic or like granular materials or flowable powder-like material.

A common container for the above purpose comprises a four sided rectangular wall structure mounted on a pallet to form a container. A plastic bag is placed in the container and the bag is filled with the material to be transported. Discharge of the material is through a gate forming the lower part of one side of the wall structure. The gate is of the lift-up type so as to expose the bag adjacent the container bottom (the pallet) when the gate is opened. Once the bag is exposed a discharge neck of the bag, which was located adjacent the gate when the bag was placed in the container, can be accessed and the material is then gravity discharged through the neck until the angle of repose of the material causes the flow to stop. Thereafter other devices not considered herein may used to completely empty the bag.

In an alternative arrangement where the bag has no discharge neck the exposed bag is punctured to allow the contents to discharge.

The usual arrangement is one in which the bag has a discharge neck and to avoid immediate and uncontrolled discharge through the neck when the gate is opened a floor sheet of special form is provided over the pallet. The floor sheet is rectangular and includes an upturned portion or flap on one edge which lies adjacent the lift-up gate and bears thereagainst when the gate is closed. When the gate is opened the flap resists the initial tendancy for the discharge neck to exit the container and immediately commence discharging of the bag contents. Discharge management by the flap is desirable and the present invention provides an alternative construction to that described above.

With the construction proposed herein the side of the wall structure which is fitted with the gate is also fitted with a hinged flap which operates in a manner similar to the flap previously forming part of the floor sheet. The main benefit of the present invention is that the setting-up of the container for filling is simpler than with the floor sheet/flap arrangement used hitherto.

Broadly the present invention can be said to provide a discharge side for a container to permit the gravity discharge of flowable non-liquid material from a plastic bag housed in the container where the container is comprised of a multi-sided circumscribing wall means and a base, said discharge side comprises a rectangular frame with a top rail, a bottom rail and two uprights which join the respective ends of the said rails and a covering for said frame comprised of an upper covering sheet mounted on said frame and terminating with a bottom edge spaced from the bottom rail and a lower covering sheet which extends between the bottom edge of the upper covering sheet and the bottom rail of said frame, hinge means connects the lower covering sheet to the frame so the lower covering sheet is outwardly downwardly movable between said uprights and relative to said frame, an upwardly outwardly opening gate is hingedly connected to said frame and locking means is provided to releasably lock said gate closed in overlying relationship with the lower covering sheet thereby to retain said lower covering sheet in an operative position as a substantially coplanar extension of said upper covering sheet.

Figure 2:
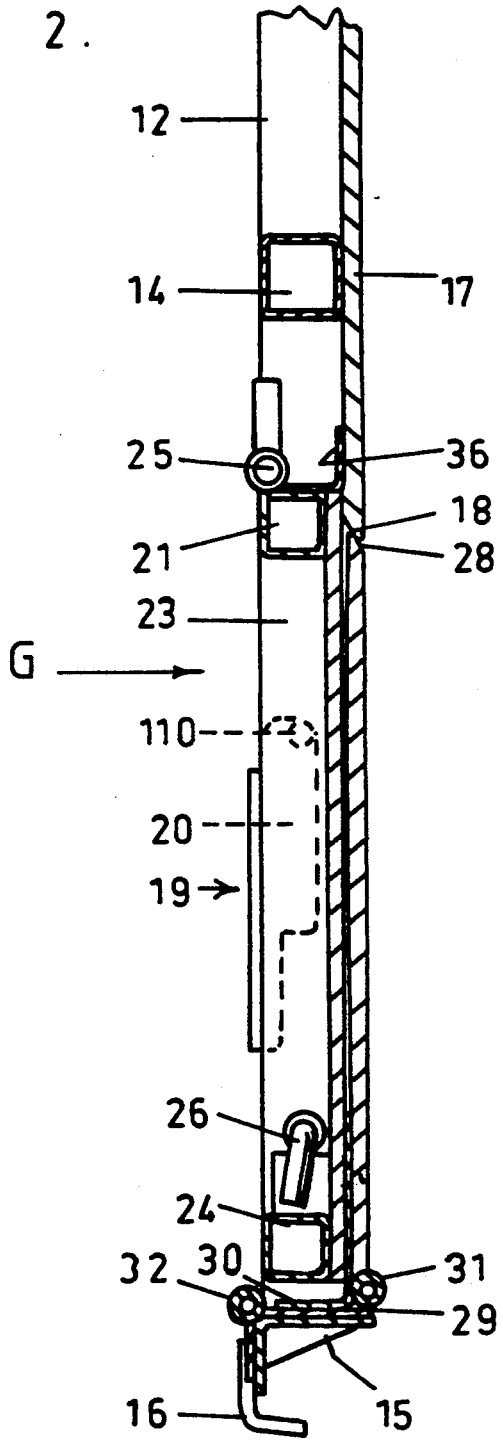
Figure 3:
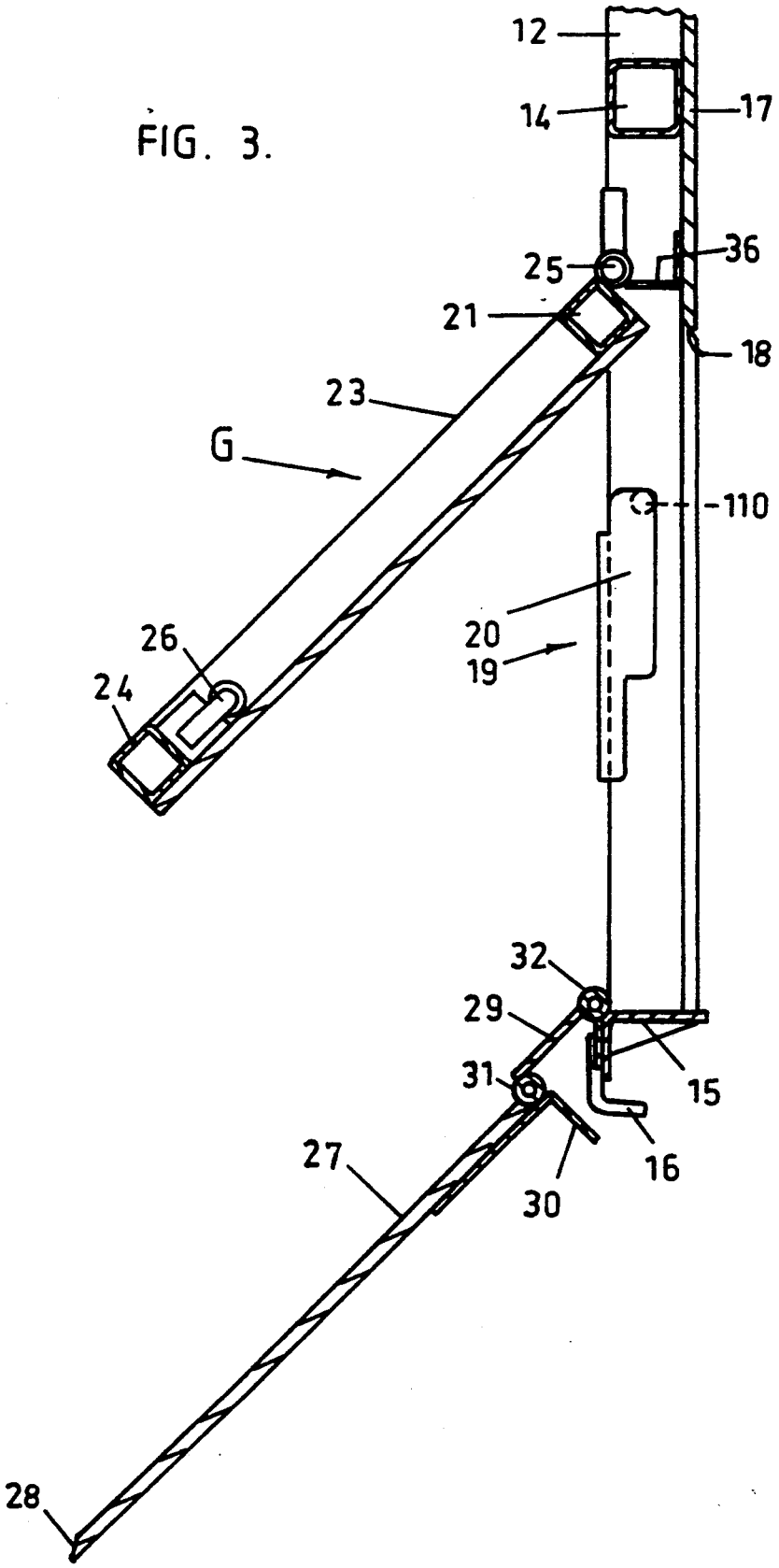
Figure 4:
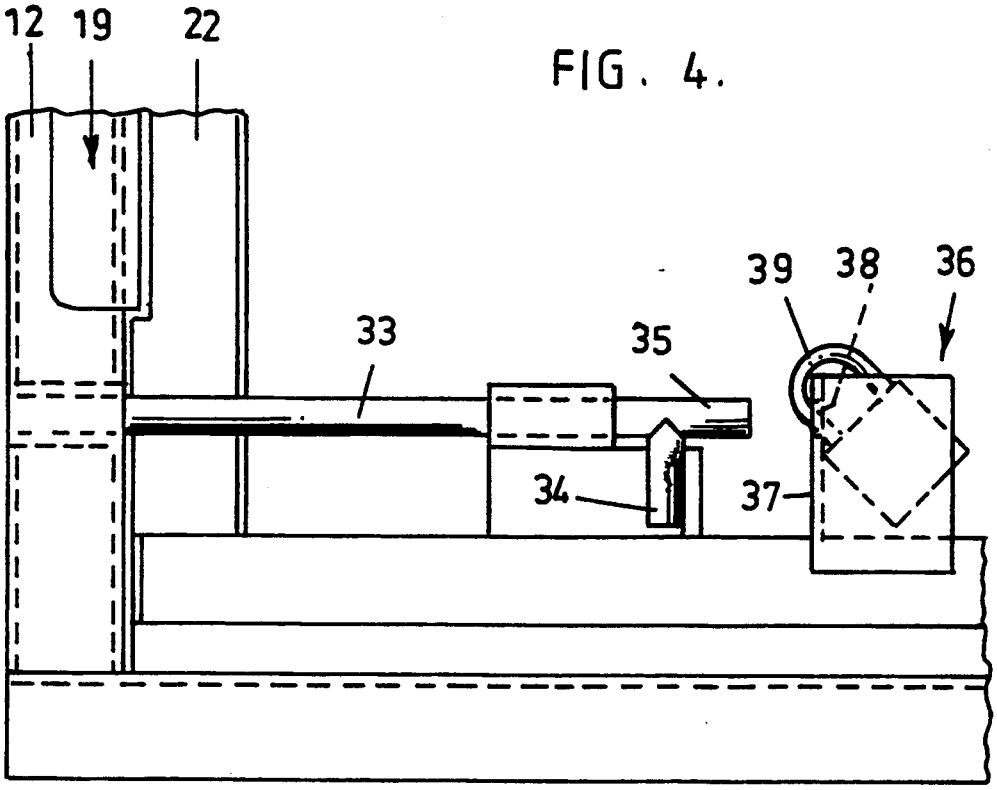
Figure 5:
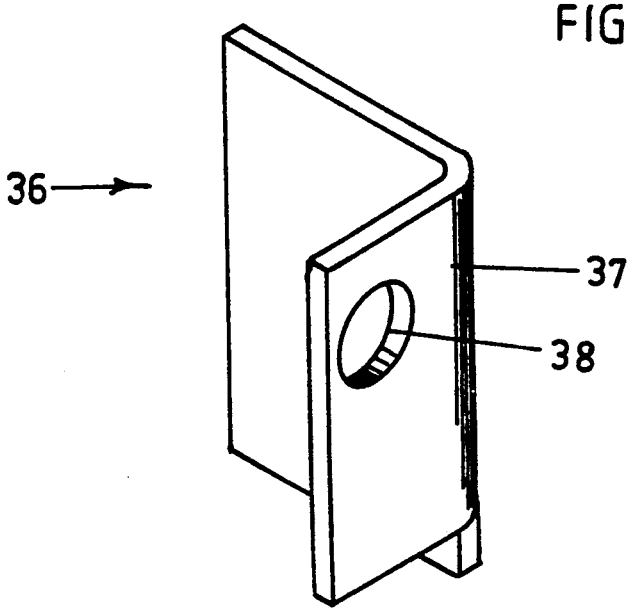

A presently preferred embodiment of the invention will now be described with reference to the accompanying drawings in which;

FIG. 1 is a perspective view of a container incorporating a discharge side according to the invention with the discharge side shown in full lines and the other container sides shown in broken lines, FIG. 2 is a fragmentary sectional side elevation of the discharge side of FIG. 1 when in a closed condition, FIG. 3 is a view similar to FIG. 2 when the discharge side is in the open condition, FIG. 4 is a fragmentary front elevation of a corner of the discharge side of FIG. 1 showing an alternative form of releasable lock means for the gate thereof and FIG. 5 is a perspective view of a bracket used as a security means to prevent the unauthorised opening of the lock means of FIG. 4.

As illustrated in FIG. 1 the container comprises a pair of fixing sides 1 and 2 fixed by cleats 3 to the battens 4 of a pallet 5 having bearers 6. There are two door sides 7 and 8 connected by hinges 9 to the fixing sides 1 and 2 and bolts 10 couple adjacent door and fixing sides together. All of the foregoing is well known and described in several other patents granted to the present applicant.

The present invention is concerned primarily with the door side 7 which comprises a top rail 11 and uprights 12 and 13 with a mid-tie bar 14 and a bottom rail 15. In the conventional door side for containers of this type the rails and uprights are constructed from square tube. That form of construction is maintained in the present instance except that the bottom rail 15 is an angle member 15 with down turned hooked legs 16 to engage under the top batten of the pallet 5. The replacement of the conventional bottom rail (normally of square tube form) with the angle member 15 minimises the ridge at the bottom of the door panel likely to impede the exit of material from the storage bag in the container.

The frame of the door side 7 also includes a cross tie angle member 36 below the tie bar 14, to be seen clearly in FIGS. 2 and 3. There is a an upper covering sheet 17 fixed to the frame members 11, 12, 13, 14, and it projects below the tie member 36, to which it is also preferably fixed. The covering sheet 17 has its lower edge outwardly upwardly chamfered as indicated 18.

An upwardly outwardly opening gate G is mounted to the frame of the side 7. The gate G is comprised of a frame made of tubular material with a top rail 21, sides 22 and 23 and a bottom rail 24 with a lining sheet fixed thereto. The top rail 21 is coupled through hinges 25 to the uprights 12 and 13. Bolts 26 are provided to hold the gate G closed with the coupling ends of the bolts 26 engaged in holes in the uprights 12 and 13. The bolts 26 may be of a security type as will be hereinafter further discussed.

It is to be noted that the bolt 10 and 110 differ. The bolt 10 is of the conventional form disclosed in the applicants previous patents with a bar body and handle part formed by bending a steel rod and there is a lug (not shown) on the free end of the bar body to enter an elongated slot in the upright of the adjacent fixing side. By rotating the bar body by the handle part the lug is locked inside the upright of the adjacent fixing side. The bolt 110 is functionally the same as the bolt 10 but the handle 19 of the bolt 110 is of a form which will allow the handle to fit in a small clearance between the upright 12 and the side 23 of a gate G. This is achieved by making the handle 19 from angle material so that the leg 20 of angle to which the bolt body is fixed will fit in the small clearance between the upright 12 and the side 23 of the gate G with the other leg of the angle overlying the upright 12. The other leg of the handle 19 is this accessible for an operator to grasp in order to rotate the bolt body in a lug releasing operation. It is also to be noted that with the gate G closed the bolt body of the bolt assembly 110 cannot be opened, see FIGS. 2 and 3.

There is a lower covering sheet 27 for the discharge side and in the side closed condition the sheet 27 is disposed behind the gate G, see FIG. 2. The sheet 27 extends substantially the full width between the uprights 12 and 13 and has its upper edge downwardly outwardly chamfered at 28 to engage with the chamfered edge 18 of the upper covering sheet 17. The lower covering sheet 27 is connected to the bottom rail 15 by means of a double hinge arrangement incorpating a hinge leaf 29 and two hinge connections 31 and 32. The hinge leaf 29 has a width between first and second edges which is substantially the same as the width of the rail 15 between its front and back edges. The hinge connection 31 connects one edge of the leaf 29 to the lower covering sheet 27 and the other hinge connection 32 connects the other edge of the leaf 29 to the front edge of the rail 15. The relationship between the widths of the rail 15 and the leaf 29 is such that when the lower covering sheet 27 is in its operative position, as shown in FIG. 3, the leaf 29 overlies and rest on the rail 15.

There is a foot member 30 on the lower covering sheet 27 and when the lower covering sheet is in its operative position the foot 30 overlies and rests on the leaf 29.

As illustrated in FIGS. 2 and 3 the double hinge arrangement allows the member 27 to be folded up into the container behind the gate G and to be folded out and down to support a bag whilst it is discharging. It frequently happens that the bag in discharging will advance from the container and the member 27 provides support for the bag and prevents choking-off of the material flow from the bag by it drooping sharply over the bottom rail 15, as could occur if the member 27 was not maintained in the angled position shown in FIG. 3. This angled condition can be achieved in several ways, for example, by engagement between the member 30 and the hooks 15*a*. Alternatively, as the container will always be elevated for a discharge operation the edge 28 of the member 27 could rest upon a support, e.g. the top of a bin or the like into which the contents of the container are being emptied.

It is to be noted that the construction of the member 27, its sizing, the location of the lower edge of the member 17 and the chamfers 18–28 all contribute to a controlled set-up of the apparatus for controlled discharge of material. By way of example, the lower covering sheet 27 has a height which approximates but does not exceed that of the gate G so that the lower covering sheet 27 cannot be hingedly opened outwardly downwardly until the gate G has been opened upwardly outwardly through a predetermined angle. This is clear from FIG. 3.

If an attempt is made to open the member 27 before the gate G is opened sufficiently the edge 28 of the member 27 will come to rest on the upper edge of the gate rail 21 and will remain so engaged until the gate G is opened further and sufficiently to release the edge 28 of the member 27. This "interlock" prevents the pressure within a container suddenly forcing the member 27 open in an uncontrolled manner once the gate bolts 26 are released.

With the arrangement just described once the bolts 26 have been released the gate G can be raised initially to allow pressure to be exerted against the member 27 which can then be lowered in a controlled manner once the gate G has been raised sufficiently to release it.

It is to be noted that the hinge 32 presents substantially no lip to inhibit the flow of the material from a container bag thereby ensuring maximum discharge prior to the achievement of the slump angle of the material.

A variation of the form of the bolt 26 will now be described with reference to FIGS. 4 and 5. The bolt member 33 of FIG. 4 is not provided with the bent end shown in FIG. 1 but is provided with a right angle leg 34 and the bolt body 33 has a portion 35 extending beyond the leg 34. There is a security bracket 36 of angle form as illustrated in FIG. 5 fixed to the rail 24. The bracket includes a leg 37 with a hole 38 therethrough to accept the bolt portion 35 when the assembly is not in security mode. This allows the work end of the bolt 33 to disengage from a co-operating hole in the upright 12.

When the security mode is to be invoked the hasp part of a padlock 38 or the like is fixed in the hole 38 thereby preventing the bolt portion 35 from entering the hole and thus preventing the bolt from release from the hole in the upright 12. In this way a simple and effective security lock can be provided for one or both of the bolt assemblies 26.

I claim:

1. A discharge side for a container to permit the gravity discharge of flowable non-liquid material from a plastic bag housed in the container where the container is comprised of a multi-sided circumscribing wall means and a base, said discharge side comprises a rectangular frame with a top rail, a bottom rail and two uprights which join the respective ends of the said rails and a covering for said frame comprised of an upper covering sheet mounted on said frame and terminating with a bottom edge spaced from the bottom rail and a lower covering sheet which extends between the bottom edge of the upper covering sheet and the bottom rail of said frame, hinge means connects the lower covering sheet to the frame so the lower covering sheet is outwardly downwardly movable between said uprights and relative to said frame, an upwardly outwardly opening gate is hingedly connected to said frame and locking means is provided to releasably lock said gate closed in overlying relationship with the lower covering sheet thereby to retain said lower covering sheet in an operative position as a substantially coplanar extension of said upper covering sheet.

2. A discharge side as claimed in claim 1 wherein said uprights are respectively hingedly connected and releasably coupled to adjacent uprights of adjacent sides of said circumscribing wall means.

3. A discharge side as claimed in claim 2 wherein said releasable coupling is by bolts slidably and part rotatably mounted on said frame, each said bolt includes a laterally extending lug to pass through a correspondingly shaped hole in said adjacent upright so that on rotation of said bolts said lugs engage said adjacent upright and prevent axial withdrawal of said bolts therefrom.

4. A discharge side as claimed in claim 3 wherein one of said bolts is positioned in the frame upright between the bottom edge of the upper lining sheet and the bottom rail of the frame and axial movement of said one bolt in a withdrawing direction is prevented when said gate is in its closed condition.

5. A discharge side as claimed in claim 1 wherein the releasable lock means for said gate comprises axially and part rotatable bolts mounted on the gate and respectively engagable in the uprights of said frame.

6. A discharge side as claimed in claim 1 wherein said bottom rail has a width dimension defined by an inner edge and an outer edge and said lower covering sheet is hingedly connected to the bottom rail of said frame by hinge means of double hinge device including a hinge leaf which has a width dimension between first and second edges which is substantially equal to that of said bottom rail, a first hinge connection connects said lower covering sheet and the first edge of said hinge leaf and a further hinge connection connects the second edge of said hinge leaf to said outer edge of said bottom rail so that when said lower covering sheet is in said operative position said hinge leaf overlies said bottom rail.

7. A discharge side as claimed in claim 6 including a foot member on said lower covering sheet adapted to overlie and rest upon said hinge leaf when said hinge leaf is in overlying relationship with said bottom rail.

8. A discharge side as claimed in claim 1 wherein the lower edge of said upper covering sheet is upwardly outwardly chamfered and an upper edge of said lower covering sheet is downwardly outwardly chamfered and said chamfers abut when said lower covering sheet is in its operative position.

9. A discharge side as claimed in claim 8 wherein the lower covering sheet has a height which approximates but does not exceed that of said gate so that said lower covering sheet cannot be opened outwardly downwardly until said gate has been opened upwardly outwardly through a predetermined angle.

* * * * *